US005501774A

United States Patent [19]

Burke

[11] Patent Number: 5,501,774

[45] Date of Patent: Mar. 26, 1996

[54] PRODUCTION OF FILLED PAPER

[75] Inventor: Anthony J. Burke, North Yorkshire, England

[73] Assignee: Allied Colloids Limited, West Yorkshire, England

[21] Appl. No.: 188,388

[22] Filed: Jan. 21, 1994

[30] Foreign Application Priority Data

Jan. 26, 1993 [GB] United Kingdom ..... 9301451

[51] Int. Cl.[6] ..... D21H 21/10

[52] U.S. Cl. ..... 162/164.1; 162/164.6; 162/168.1; 162/168.2; 162/168.3; 162/175; 162/181.2; 162/181.6; 162/181.8

[58] Field of Search ..... 162/181.6, 181.8, 162/183, 175, 168.1, 168.2, 168.3, 164.1, 164.6, 164.3, 181.2

[56] References Cited

U.S. PATENT DOCUMENTS

| | | | |
|---|---|---|---|
| 4,445,970 | 5/1984 | Post et al. | 162/181.8 |
| 4,749,444 | 6/1988 | Lorz et al. | 162/181.8 |
| 4,795,531 | 1/1989 | Sofia et al. | 162/183 |
| 4,902,382 | 2/1990 | Sakabe et al. | 162/181.8 |

FOREIGN PATENT DOCUMENTS

| | | |
|---|---|---|
| 0017353 | 10/1980 | European Pat. Off. . |
| 0223223 | 5/1987 | European Pat. Off. . |
| 0522940 | 1/1993 | European Pat. Off. . |
| 2578870 | 9/1986 | France . |

OTHER PUBLICATIONS

Data Base Paperchem–The Institute of Paper Science and Technology, Atlanta, GA, "Improvement in Retention of Filler in Papermaking", *E. Maegawa,* & JAP. Pat. Kokai 61,588/89, Mar. 8, 1989, Kyoritsu Yuki Co., Ltd.

*Primary Examiner*—Peter Chin

*Attorney, Agent, or Firm*—Sughrue, Mion, Zinn, Macpeak & Seas

[57] ABSTRACT

Filled paper is made by providing an aqueous feed suspension containing filler and cellulosic fibre, coagulating the fibre and filler in the suspension by adding cationic coagulating agent, making an aqueous thinstock suspension by diluting a thickstock consisting of or formed from the coagulated feed suspension, adding anionic particulate material to the thinstock or to the thickstock from which the thinstock is formed, subsequently adding polymeric retention aid to the thinstock and draining the thinstock for form a sheet and drying the sheet.

12 Claims, No Drawings

PRODUCTION OF FILLED PAPER

This invention relates to the improvement of retention, especially filler retention, in the production of filled paper (including paper board).

BACKGROUND OF THE INVENTION

Filled paper is made by a process comprising providing a dilute aqueous suspension (termed a thinstock) of cellulosic fibres and filler, draining the thinstock suspension to form a sheet, and drying the sheet. It is desirable to retain as much as possible of the filler and fibre, including fibre fines, in the sheet and it is normal to add a retention aid to the thinstock in order to promote retention.

The thinstock is usually made by diluting with water (typically white water from the drainage stage) a more concentrated suspension of filler and cellulosic fibre. This more concentrated suspension is normally called the thickstock. The thickstock may be made merely by blending together the desired amounts of a single supply of fibre, a single supply of filler and water, or by blending several different supplies of fibre and/or filler and water.

Some of the feed to the thickstock can be recycled material, for instance deinked pulp, and if the recycled pulp contains filler this previously used filler will be incorporated into the thickstock. Often additional, previously unused, filler is incorporated into the thickstock or thinstock.

Polymers of a wide range of molecular weights can be used as retention aids, and it is also known to add a high molecular weight polymeric retention aid to the thinstock after incorporating a lower molecular weight polymeric coagulant into the thinstock or even the thickstock.

For instance it is known to treat unused filler with polymeric coagulant before adding that filler to the thickstock. The purpose of this coagulant addition is to coagulate the filler and thereby improve its retention. Unfortunately the process tends to result in the filler being less satisfactory (e.g. it gives less opacification) and so the addition of coagulant in this manner is not entirely satisfactory.

In many processes for making filled paper, a cationic, high molecular weight, retention aid is added to the thinstock formed from good quality pulp (of low cationic demand). In such processes, the addition of retention aid usually results in improved retention of both filler and fines.

In EP-A-17353 a relatively crude pulp, having high cationic demand, is treated with bentonite followed by substantially non-ionic polymeric retention aid. Although the suspension in this process is a substantially unfilled suspension, in AU-A-63977/86 a modification is described in which the suspension can be filled and in which bentonite is added to thickstock, the thickstock is then diluted to form thinstock, a relatively low molecular weight cationic polyelectrolyte is added to the thinstock, and a high molecular weight non-ionic retention aid is then added. Thus in this process, coagulant polymer is used, and it is added to the thinstock after the bentonite.

Processes such as those in EP 17353 and AU 63977/86 are satisfactory as regards the manufacture of paper from a suspension that has relatively high cationic demand and relatively low filler content, but tend to be rather unsatisfactory as regards filler retention when the suspension contains significant amounts of filler.

It would be desirable to be able to improve filler retention in paper-making processes such as those of EP 17353 and AU 63977/86.

DETAILED DESCRIPTION OF THE INVENTION

A process according to the invention for making filled paper comprises providing an aqueous feed suspension containing 2.5 to 20% by weight of filler and cellulosic fibre in a dry weight ratio of 10:1 to 1:50 (preferably 1:1 to 1:50), making an aqueous thinstock suspension by diluting with water an aqueous thickstock suspension consisting of or formed from the feed suspension, adding bentonite or other anionic particulate material to the thinstock or to the thickstock from which the thinstock is formed, subsequently adding polymeric retention aid to the thinstock, draining the thinstock to form a sheet, and drying the sheet, and in this process the filler is coagulated with the fibre in the feed suspension by adding cationic coagulating agent to the feed suspension.

Although it is known to add similar cationic coagulating materials to the filler before addition to the feed suspension or to the thinstock, we obtain significant benefit by adding the coagulant at the stage where the filler is present as a mixture with fibre in a relatively concentrated suspension of the filler and fibre. It seems that there are three reasons for this. First, the presence of fibre with the filler means that filler is coagulated in the presence of fibre to form aggregates of filler and fibre that are then trapped in the sheet during the drainage, thereby improving retention. Second, as a result of adding the coagulant at a time when the suspension is relatively concentrated, the coagulant can more effectively interact with the suspended material to form mixed aggregates of filler and fibre and the effectiveness of the coagulant is not lessened by, for instance, interference due to chemical interaction with impurities in white water or other dilution water utilised for making the thinstock. Third, the filler is retained preferentially as a result of being present at a high relative concentration, especially if the concentration of fibre fines is low.

The thickstock may consist wholly of the defined aqueous feed suspension, in which event this feed suspension is diluted after the coagulation stage to form the thinstock. Generally, however, the thickstock is made by blending the defined aqueous feed suspension with one or more other concentrated suspensions containing cellulosic fibre.

Generally as much as possible of the total amount of filler is treated with coagulant in the presence of fibre, as described. However it can be desirable to add some filler separately, e.g. to the thinstock to allow more rapid changes in filler addition to maintain a predetermined quality. Also some filler may be carried into the thinstock as a result of dilution of the thickstock with white water from the drainage stage. For instance usually at least 50%, and preferably at least 70%, of the total amount of filler in the thinstock has been treated in the described manner. Preferably at least 50%, and generally at least 70%, of the filler in the thickstock is treated in the defined manner and in some processes it is possible for 100% of the filler in the thickstock to be treated in this manner.

The filler in the thickstock usually originates in part from recycled cellulosic material and in part from freshly added (i.e., unused) filler. Recycled cellulosic material may be broke formed of filled or coated paper or, more importantly, deinked pulp formed from filled paper.

In the invention, the filler in the feed suspension containing filler and cellulosic fibre may be incorporated by adding unused filler or by recycling cellulosic material containing filler (especially deinked pulp) or both.

Preferably the defined feed suspension contains substantially all the filler from recycled cellulosic material that is to be incorporated into the thickstock and so preferably substantially all (e.g. at least 70% and preferably 100%) the recycled cellulosic material (including filler) is in the feed suspension. Preferably the feed suspension contains some (e.g. at least 25 or usually at least 50% by weight) or substantially all (e.g. at least 70% and preferably 100%) of the unused filler that is to be incorporated into the final thinstock.

In a preferred process, the thickstock is formed by blending at least one suspension of cellulosic fibres that is substantially free of filler with an aqueous feed suspension formed by blending unused filler with deinked pulp (and optionally other pulp), and the filler in this feed suspension is coagulated with fibres in accordance with the invention. The coagulated feed suspension is blended with the other fibre-containing suspension or suspensions to form the thickstock, which is then diluted to form the thinstock.

The feed suspension that is coagulated must have a total solids content of at least about 2.5% and usually at least about 3% by weight. The viscosity and flow properties of the suspension may make difficult to handle if the solids content is higher than about 10% and generally the total solids content of the suspension is not more than about 6%. Normally the suspended solids in the suspension consist wholly or mainly of filler and cellulosic fibre (including fibre fines).

It is necessary that the feed suspension should contain fibre (including fibre fines) at the time of coagulation. Preferably the amount of fibre fines is minimised. The amount of cellulosic fibre (including fines) in the feed suspension should normally be at least about 0.1 parts dry weight per part dry weight filler since if the amount is less than this there may be inadequate fibre to provide the desired benefit. Normally the amount of fibre is at least about 0.5 or 1 part up to about 10 parts per part filler. If the amount of fibre is more than about 50 parts per part by weight filler, the commercial value in the invention may be rather low since the total filler content in the final paper would inevitably then be low and so filler retention may not be a significant problem.

The amount of filler in the thinstock typically ranges from about 0.05 to 3 parts, preferably around 0.1 to 1 part, dry weight filler per part dry weight cellulosic fibre. The amount of filler in the final paper is usually about 2 to 50%, often above 5% or 10% and often up to 20% or 30%, based on that total dry weight.

The filler can be any of the fillers suitable for use in the product of filled paper, including china clay, calcium carbonate or kaolin.

The thickstock generally has a total solids content in the range about 2.5 to 10%, usually about 3 to 6%, by weight and the thinstock typically has a total solids content in the range about 0.25 to 2% by weight.

The cationic coagulating agent that is added to the aqueous feed suspension may be an inorganic coagulating agent such as alum, sodium aluminate or polyaluminium chloride or sulphate but is preferably a cationic polymeric coagulating agent. This can be a cationic naturally occurring polymer (including a modified naturally occurring polymer) such as cationic starch but is usually a synthetic, a low molecular weight cationic polymer having intrinsic viscosity normally below about 3 dl/g. The intrinsic viscosity is measured by a suspended level viscometer at 25° C. in 1 molar sodium chloride aqueous solution buffered to pH 7.0. Generally IV is in the range 0.1 to 3 dl/g, with best results generally being obtained in the range 0.2 to 2.4 dl/g. Suitable polymers often have molecular weight, measured by gel permeation chromatography, below about 2 million, preferably below 1.5 and most preferably below 1 million, and often below 100,000, e.g. down to 30,000 although lower values, e.g. down to 10,000, are suitable for some polymers such as dicyandiamides.

The coagulant polymer can be a polyethylene imine, a dicyandiamide or a polyamine (e.g., made by condensation of epichlorhydrin with an amine) but is preferably a polymer of an ethylenically unsaturated cationic monomer, optionally copolymerised with one or more other ethylenically unsaturated monomers, generally non-ionic monomers. Suitable cationic monomers are dialkyl diallyl quaternary monomers (especially diallyl dimethyl ammonium chloride) and dialkylaminoalkyl -(meth) acrylamides and -(meth) acrylates as acid addition or quaternary ammonium salts. Preferred polymers are polymers of diallyl dimethyl ammonium chloride or quaternised dimethylaminoethyl acrylate or methacrylate, either as homopolymers or copolymers with acrylamide. Generally the copolymer is formed of 50 to 100%, often 80 to 100%, cationic monomer with the balance being acrylamide or other water soluble non-ionic ethylenically unsaturated monomer.

The amount of coagulant polymer that is added to the feed suspension is typically in the range of about 0.005 to 2%, preferably about 0.01 to 1%, based on the dry weight of the suspension, but when the coagulant material is inorganic the amount may typically be about 2 to 10%, e.g. about 5%. The amount of organic coagulant based on the dry weight of paper is typically about 0.005% to 0.5%, preferably 0.01 to 0.2%.

It is generally preferred that the only addition of coagulant polymeric material to stock containing filler and fibre should be at the defined stage (namely the feed suspension containing filler and fibre). However coagulant can be added at other stages. For instance if desired conventional additives such as pitch control additives may be added, for instance to the initial fibre thickstock. Low molecular weight cationic polymers can be used for this, as is conventional.

The invention can be used on a wide range of pulps, including pulps that are relatively pure and that have a low or very low cationic demand. However an advantage of the process is that it can be used successfully when the thinstock has a relatively large amount of anionic trash in it. This can be generated as a result of forming the thinstock from significant amounts (e.g. at least 30% and often at least 50% by weight of total pulp of deinked pulp or mechanical, thermomechanical or chemimechanical pulp. It can be generated by prolonged recycling of white water, especially when using such pulps even in quite small proportions (based on total pulp).

Generally the anionic content of such a thinstock is such that the thinstock (in the absence of the added coagulant) has a relatively high cationic demand. For instance this can be at least 0.06% and usually at least 0.1% when the thinstock is made up in the same manner as in the intended process but with the omission of the coagulant addition, and a sample of the thinstock is titrated against polyethyleneimine (PEI) to determine how much polyethyleneimine has to be added before a significant improvement in retention is obtained. The value of 0.06% indicates that it is necessary to add at least 600 g/t PEI in order to obtain a significant improvement in retention.

Another way of expressing cationic demand is to filter a sample of the thinstock through a fast filter paper and titrate the filtrate against a standardised polyDADMAC solution, for instance using a Mutek Particle Charge Detector. The concentration of anionic charge in the filtrate from a high cationic demand thinstock is usually in excess of 0.01 millemoles/l, and often above 0.1 millemoles/1.

The anionic particulate material is added to the stock before the polymeric retention aid is added. The particulate material can be added to the thinstock or to the thickstock, but if it is being included in the thickstock it should be added after the coagulant, as otherwise it may be coagulated with the fibre and filler. When there is a single feed to the thickstock, it must be added to that feed after coagulation but when there are several feeds to the thickstock it can be added either after the feeds have been blended or to a feed to which coagulant is not being added.

The particulate material can be any swelling clay and generally is a material usually referred to as a bentonite. Generally it is a smectite or montmorillonite or hectorite that will act as a swelling clay, for instance as described in EP 17353 or EP 235893. Materials commercially available under the names bentonite and Fullers Earth are suitable. Instead of using a swelling clay, other anionic material that has very large surface area may be suitable. It should have a very small particle size, for instance below 3 μm and preferably below 0.3 μm or even 0.1 μm. Examples include silicic compounds such as particulate polysilicic acid derivatives, zeolite, and anionic polymeric emulsions. Instead of using a wholly anionic clay or polymer, an amphoteric clay or polymer (that includes some cationic groups and, usually, a larger amount of anionic groups) can be used.

The amount of bentonite or other particulate material that is added is generally about 0.02 to 2% dry weight based on the dry weight of the suspension.

The polymeric retention aid used in the invention is preferably a synthetic polymer having intrinsic viscosity above about 4 dl/g and often above about 6 dl/g.

The retention aid can be cationic in which event it is normally a copolymer of acrylamide with up to 50 weight % cationic monomer, generally a dialkylaminoalkyl (meth)-acrylate or - acrylamide salt. It can be anionic in which event it may be a copolymer with up to 50 weight % of an anionic ethylenically unsaturated monomer, generally sodium acrylate.

Preferably, however, the polymer is substantially non-ionic. It can be intended to be wholly non-ionic in which event it may be, for instance, polyethyleneoxide or polyacrylamide homopolymer (optionally including up to about 2 mol % sodium acrylate in the polymer) or it may be slightly anionic or slightly cationic. For instance it can contain up to 10 or 15 mol % anionic groups and up to 5 or 10 mol % cationic groups.

Preferred polymers are polymers having intrinsic viscosity of at least 4 dl/g and formed of acrylamide alone or with up to 5 mol % cationic groups (preferably dialkylaminoalkyl acrylate or methacrylate quaternary salt) and/or with up to 8 mol % anionic groups (preferably sodium acrylate). Instead of using sodium acrylate, other water soluble acrylate salts or other anionic monomer groups can be used.

The amount of polymeric retention aid that is added is generally in the range 100 to 1,500 grams per ton dry weight. The optimum amount may be selected in accordance with conventional practice.

The overall paper making process may, apart from the defined coagulant and filler addition, be conventional and may be conducted to make newsprint or other grades of paper, including paper-board.

The following are some examples. In each of these, the slightly anionic retention aid was a copolymer of 95 mole % acrylamide and 5 mole % sodium acrylate and intrinsic viscosity 12 dl/g.

EXAMPLE 1

An aqueous feed suspension was made by blending 10% (on eventual total solids) of calcined clay filler with deinked pulp (DIP) to form an aqueous feed suspension having a total solids content of 3.5% and a dry weight ratio of filler:fibre of 1:4. In another test the aqueous feed suspension was formed from DIP alone.

The feed suspension was blended with a suspension formed from TMP, Goundwood and Magnafite pulps (referred to below as pulp feed). The blend of these suspensions was thickstock having a total filler content of 16% and a total fibre content of 84%, based on total solids.

This thickstock was then diluted with clarified whitewater to form a thinstock of consistency of 0.79%.

Bentonite in an amount of 4000 g/t was added to the thinstock suspension and, after thorough mixing, 400 g/t (dry basis) of a slightly anionic polyacrylamide retention aid was added and mixed. The treated thinstock was drained to form a sheet that was dried.

In a process according to the invention, a cationic coagulant consisting of polydiallyl ammonium chloride with an intrinsic viscosity of about 0.4 dl/g was added in the amounts and positions specified below. The first pass retentions observed. Addition point A was to the aqueous feed containing DIP alone. B was to aqueous feed containing DIP and calcined clay. C was to the "pulp feed". D was to the thinstock before the addition of bentonite.

TABLE 1

| Cationic Coagulant Dosage (g/t) | Cationic Coagulant Addition Point | First Pass Retention (%) |
|---|---|---|
| 0 | — | 80.6 |
| 500 | A | 81.5 |
| 1000 | A | 82.6 |
| 500 | B | 82.6 |
| 1000 | B | 83.4 |
| 2000 | B | 85.8 |
| 500 | C | 80.6 |
| 1000 | C | 80.8 |
| 500 | D | 80.5 |
| 1000 | D | 78.4 |
| 2000 | D | 79.6 |

These results clearly indicate that adding the cationic coagulant to the thinstock makes the retention worse and that adding the coagulant to unfilled pulp is not significant, whereas improvements in retention can be obtained by adding the cationic coagulant to the DIP, especially the DIP with premixed calcined clay.

EXAMPLE 2

An aqueous feed suspension is made by blending thermomechanical pulp (TMP), cold caustic soda pulp (CCS) and unbleached kraft pulp (UBK) to form an aqueous feed suspension which is then blended with calcined clay filler. The blend of these suspensions was a thickstock having a consistency of 3.5% and a dry weight ratio of filler to fibre ratio of 1:1.5.

This thickstock was diluted with whitewater to a thinstock having a filler content of 26%, a fibre content of 74% and a consistency of 0.887%.

Bentonite is an amount of 3000 g/t was added to this suspension unless stated otherwise and, after thorough mixing, 250 g/t of a slightly anionic polyacrylamide retention aid was added and mixed. The treated thinstock was then drained to form a sheet that was dried.

In a process according to the invention, a cationic coagulant consisting of polydiallyl dimethyl ammonium chloride (polyDADMAC) with an intrinsic viscosity of 0.4 dl/g was added to the clay alone or to various clay fibre suspensions specified in Table 2 below and the first pass retentions observed.

TABLE 2

| Cationic Coagulant Dosage (g/t) | Cationic Coagulant Addition Point | Anionic Flocculant Dosage (g/t) | First Pass Retention |
|---|---|---|---|
| 0 | — | 100 | 45.0 |
| 0 | — | 250 | 53.8 |
| 0 | — | 500 | 66.3 |
| 3000 | Calcined Clay | 250 | 52.0 |
| 6000 | " | 250 | 52.8 |
| 9000 | " | 250 | 55.2 |
| 3000 | Thickstock + Calcined Clay | 250 | 55.2 |
| 6000 | " | 250 | 60.2 |
| 9000 | " | 250 | 69.2 |
| 3000 | Thinstock (prebentonite) | 250 | 51.2 |
| 6000 | " | 250 | 52.6 |
| 9000 | " | 250 | 52.1 |
| 3000 | Thinstock (post bentonite) | 250 | 46.3 |
| 6000 | " | 250 | 41.4 |
| 9000 | " | 250 | 40.0 |
| 3000 | Backwater + Calcined Clay | 250 | 50.2 |
| 6000 | " | 250 | 48.9 |
| 9000 | " | 250 | 50.7 |

Those results clearly indicate that adding the cationic coagulant after the bentonite (as is AU 63977/86) makes the retention worse. Adding it to the calcined clay has minimal or deterious effect while adding it to the thickstock with premixed calcined clay produces improvements in first pass retention.

EXAMPLE 3

In a stock identical to that used in Example 2 two systems were evaluated. One was identical to that used in Example 2 wherein the polyDADMAC coagulant was added to the thickstock containing calcined clay. In the other system, marked* in Table 3, bentonite was added to the mixed thickstock, this was diluted to thinstock, modified polyethylene imine coagulant was added to the thinstock and then the retention aid was added. In this method, the calcined clay was added to the thinstock before the coagulant.

TABLE 3

| Cationic Coagulant Dosage (g/t) | Cationic Coagulant Addition Point | Anionic Flocculant Dosage (g/t) | First Pass Retention (%) | First Pass Ash Retention (%) |
|---|---|---|---|---|
| 0 | — | 0 | 40.4 | 3.0 |
| 0 | " | 100 | 47.6 | 15.4 |
| 0 | " | 250 | 53.5 | 28.2 |
| 0 | " | 500 | 71.0 | 49.0 |
| 1500 | Thickstock + Calcined Clay | 250 | 54.3 | 34.7 |

TABLE 3-continued

| Cationic Coagulant Dosage (g/t) | Cationic Coagulant Addition Point | Anionic Flocculant Dosage (g/t) | First Pass Retention (%) | First Pass Ash Retention (%) |
|---|---|---|---|---|
| 3000 | Thickstock + Calcined Clay | 250 | 59.4 | 42.4 |
| 6000 | Thickstock + Calcined Clay | 250 | 61.6 | 46.9 |
| 9000 | Thickstock + Calcined Clay | 250 | 62.2 | 51.2 |
| 0* | — | 250 | 59.5 | 36.6 |
| 1500* | Thinstock (postbentonite) | 250 | 52.9 | 27.1 |
| 3000* | Thinstock (postbentonite) | 250 | 42.3 | 10.3 |
| 6000* | Thinstock (postbentonite) | 250 | 39.4 | 0.6 |

These results clearly indicate that adding the cationic coagulant to the thinstock after the bentonite (as in AU-A-63977/86) makes the retention worse and the best improvement in retention is obtained when the cationic coagulant is added to the thickstock feed suspension containing the calcined clay.

Comparison of the first pass retention and first pass ash retention results from Table 3 show that the pre-addition of cationic coagulant to the thickstock containing calcined clay helped to preferentially retain the calcined clay as, for a given first pass retention, the first pass ash retentions were higher, while this was not the case when the cationic coagulant was added after the bentonite in the thinstock.

EXAMPLE 4

A mill had been operating using the pulps of Examples 2 and 3 with the bentonite being included in the thickstock and the calcined clay all being added to the thinstock. Based on the recommendations of the laboratory work obtained in Examples 2 and 3 the mill altered their wet end chemistry and ran a machine trial utilising a cationic coagulant addition.

75% of the calcined clay addition was moved from the thinstock to the thickstock, so that the clay was split in a ratio of 3:1 between the mixed thickstock and the thinstock. The mixed thickstock and calcined clay was then treated with up to 400 g/t of the polyDADMAC coagulant (dry coagulant on total dry papermaking solids). After mixing, the treated thickstock was diluted with backwater and the remaining clay to form the thinstock. The bentonite and anionic polyacrylamide were added, respectively, immediately before and after the last point of shear, before the machine headbox.

Splitting the feed of calcined clay enabled the majority of the clay to be treated as in the invention while the thinstock addition of calcined clay enabled the mill to adjust the sheet capacity quickly.

When using 400 g/t (dry polymer on eventual dry paper) of the cationic coagulant used in Examples 2 and 3, the mill obtained the following benefits compared to not using the cationic coagulant:

a) 29% reduction in total calcined clay flow.

b) 51% reduction in headbox ash.

c) 53% reduction in backwater ash.

d) Increase in opacity of the paper from 89 to 91.

As opacity was the sole criterion by which calcined clay addition was judged, the mill could have further reduced their calcined clay usage and still maintained their original product specification of an opacity value of 88.

EXAMPLE 5

An aqueous feed suspension was made by blending TMP and DIP thickstocks in a dry weight ratio of 1.5:1 to form an aqueous feed having a total solids content of 3.3% and a dry weight ratio of filler to fibre (including cellulose fines) of 0.05:1. The thickstock was diluted to a consistency of 0.9% with clarified whitewater.

Bentonite (B) in an amount of 4 kg/t and a polyDADMAC coagulant (C) as used in Examples 2, 3 and 4 at a dosage of 0.5 kg/t were added in various orders and addition points as specified in the table below. All tests contained the final post addition of 0.4 kg/t of a slightly anionic polyacrylamide retention aid.

As well as the standard first pass retentions, turbidity and cationic demand tests were conducted on the thinstock filtrates as an indication of the effectiveness of the various addition points in retaining the soluble and colloidal materials with the papermaking materials and removing them from the aqueous phase.

The tests on the thinstock were conducted on laboratory thinstock prepared by mixing RCF, TMP post bleaching and clarified whitewater.

TABLE 4

| First Addition | Second Addition | Filtrate Cationic Demand milli eq/l | Filtrate Turbidity (NTU) | First Pass Retention |
|---|---|---|---|---|
| C - Thick | B - Thick | 0.149 | 13.3 | 82.1 |
| B - Thick | C - Thick | 0.115 | 14.5 | 79.8 |
| C - Thick | B - Thin | 0.108 | 12.0 | 83.1 |
| B - Thick | C - Thin | 0.156 | 14.0 | 80.8 |
| C - Thin | B - Thin | 0.116 | 12.0 | 81.9 |
| B - Thin | C - Thin | 0.110 | 13.0 | 80.5 |

As can be seen from the table, in terms of first pass retention the best results were always obtained where the cationic coagulant was added first with the optimum addition points being the cationic coagulant to the thickstock and the bentonite to the thinstock. Further, the optimum addition points for first pass retention was also the optimum addition points for retaining the soluble and colloidal materials from the aqueous phase as measured by cationic demand and turbidity.

Adding the bentonite to the thickstock and cationic coagulant to the thinstock (as in AU-A-63977/86) produced a relatively low first pass retention and relatively high turbidity and cationic demand.

I claim:

1. A process for making filled paper comprising providing an aqueous feed suspension containing 2.5 to 20% by weight of filler and cellulosic fiber in a dry weight ratio of 10:1 to 1:50 coagulating the filler with the fiber in the feed suspension by adding cationic coagulant agent to the feed suspension, the cationic coagulant agent being added to the feed suspension in an amount of at least 0.005% dry weight based upon the dry weight of the suspension and the cationic coagulant agent being selected from the group consisting of inorganic coagulating agents, cationic naturally occurring polymers and synthetic cationic polymers having intrinsic viscosity below 3 dl/g, making an aqueous thinstock suspension by diluting with water an aqueous thickstock suspension consisting of or formed from the feed suspension, adding anionic particulate material to the thinstock or to the thickstock from which the thinstock is formed, the anionic particulate material being added to the thinstock or to the thickstock from which the thinstock is formed in an amount of 0.02 to 2% dry weight based upon dry weight of suspension and the anionic particulate material being selected from the group consisting of swelling clays and particulate material having a size below 0.1 μm and being selected from the group consisting of particulate polysilicic acid compounds, zeolite and anionic polymeric emulsions, subsequently adding polymeric retention aid in an amount of 100 to 1500 grams per ton dry weight to the thinstock, the polymeric retention aid having an IV of above 4 dl/g and the retention aid being selected from the group consisting of polyethylene oxide and acrylamide polymers, said acrylamide polymers being selected from the group consisting of polyacrylamide homopolymers and copolymers of acrylamide with up to 50 weight percent cationic monomer or up to 50 weight percent anionic monomer, draining the thinstock to form a sheet, and drying the sheet.

2. In a process for making filled paper comprising providing an aqueous feed suspension containing 2.5 to 20% by weight of filler and cellulosic fiber in a dry weight ratio of 10:1 to 1:50, making an aqueous thinstock suspension by diluting with water an aqueous thickstock suspension consisting of or formed from the feed suspension, adding swelling clay to the thinstock or to the thickstock from which the thinstock is formed, the swelling clay being added to the thinstock or to the thickstock from which the thinstock is formed in an amount of 0.02 to 2% dry weight based on the dry weight of suspension, subsequently adding polymeric retention aid in an amount of 100 to 1500 grams per ton dry weight to the thinstock, the polymeric retention aid having an IV of above 4 dl/g and the retention aid being selected from the group consisting of polyethylene oxide and polymers formed from acrylamide with 0 to 5 mole percent cationic groups and/or 0 to 8 mole percent anionic groups, draining the thinstock to form a sheet, and drying the sheet, the improvement consisting of coagulating the filler with the fiber in the feed suspension by adding cationic coagulant agent to the feed suspension, the cationic coagulant agent being added to the feed suspension in an amount of 0.005 to 2% dry weight based upon the dry weight of suspension and being a synthetic cationic polymer having intrinsic viscosity below 3 dl/g.

3. A process according to claim 1 in which recycled cellulosic material selected from the group consisting of broke and deinked pulp is incorporated into the thickstock and in which substantially all the recycled cellulosic material is in the feed suspension.

4. A process according to claim 1 in which recycled cellulosic material selected from the group consisting of broke and deinked pulp is incorporated into the thickstock and in which substantially all the recycled cellulosic material is in the feed suspension, and in which filler in the thinstock additionally includes virgin filler and in which 50% by weight of the virgin filler is incorporated into the feed suspension.

5. A process according to claim 1 in which the feed suspension is formed by blending virgin filler with deinked pulp and, after the filler is coagulated with the fiber in the feed suspension by adding the coagulating agent, the feed suspension is blended with at least one suspension of cellulosic fibers that is substantially free of filler.

6. A process according to claim 1 in which the amount of cellulosic fiber in the feed suspension is 0.5 to 10 parts per part by weight filler.

7. A process according to claim 1 in which the coagulant is a synthetic polymer having intrinsic viscosity below 3 dl/g, the synthetic polymer being selected from the group consisting of polyethyleneimine, dicyandiamide polymers, polyamines and polymers formed from 50 to 100% cationic monomer selected from the group consisting of dialkyldiallyl quaternary monomers, dialkylaminoalkyl (meth) acrylates and dialkylaminoalkyl (meth) acrylamides, and 0 to 50% by weight acrylamide.

8. A process according to claim 1 in which the thinstock is prepared from dirty pulp selected from the group consisting of deinked pulp, mechanical pulp, thermomechanical pulp and chemimechanical pulp.

9. A process according to claim 1 in which the polymeric retention aid is a synthetic polymer selected from the group consisting of polyethyleneoxide, polyacrylamide homopolymer, and copolymers of acrylamide with up to 5 mole % cationic monomer and/or with up to 8 mole % anionic monomer.

10. A process according to claim 1 in which the anionic particulate material is bentonite.

11. A process according to claim 1 in which the anionic particulate material is bentonite and is added to the thinstock.

12. A process according to claim 2 in which the cationic coagulant agent is a synthetic polymer having intrinsic viscosity below 3 dl/g, the synthetic polymer being selected from the group consisting of polyethyleneimine, dicyandiamide polymers, polyamines and polymers formed from 50 to 100% cationic monomer selected from dialkyldiallyl quaternary monomers, dialkylaminoalkyl (meth) acrylates and dialkylaminoalkyl (meth) acrylamides, and 0 to 50% by weight acrylamide.

* * * * *